US011015250B2

(12) United States Patent
Watanabe et al.

(10) Patent No.: US 11,015,250 B2
(45) **Date of Patent: *May 25, 2021**

(54) IMPELLER FOR ROTARY MACHINE, COMPRESSOR, SUPERCHARGER, AND METHOD FOR PRODUCING IMPELLER FOR ROTARY MACHINE

(71) Applicant: MITSUBISHI HEAVY INDUSTRIES ENGINE & TURBOCHARGER, LTD., Sagamihara (JP)

(72) Inventors: Daigo Watanabe, Tokyo (JP); Takashi Arai, Tokyo (JP); Hideki Yamaguchi, Tokyo (JP); Wataru Murono, Tokyo (JP); Taiji Torigoe, Tokyo (JP); Masahiro Yamada, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 403 days.

This patent is subject to a terminal disclaimer.

(21) Appl. No.: 15/541,879

(22) PCT Filed: Mar. 17, 2015

(86) PCT No.: PCT/JP2015/057825

§ 371 (c)(1),
(2) Date: Jul. 6, 2017

(87) PCT Pub. No.: WO2016/147310

PCT Pub. Date: Sep. 22, 2016

(65) Prior Publication Data

US 2018/0002812 A1 Jan. 4, 2018

(51) Int. Cl.

| | |
|---|---|
| ***C23C 18/50*** | (2006.01) |
| ***F02M 26/04*** | (2016.01) |
| ***C23C 18/16*** | (2006.01) |
| ***F04D 29/02*** | (2006.01) |
| ***F04D 29/28*** | (2006.01) |

(52) U.S. Cl.

CPC ..... *C23C 18/50* (2013.01); *C23C 18/1646* (2013.01); *F02M 26/04* (2016.02); (Continued)

(58) Field of Classification Search

None

See application file for complete search history.

(56) References Cited

U.S. PATENT DOCUMENTS

| | | | | |
|---|---|---|---|---|
| 6,146,774 | A | 11/2000 | Okamoto et al. | |
| 6,895,992 | B2 * | 5/2005 | Yamaguchi | C23C 28/321 137/375 |

(Continued)

FOREIGN PATENT DOCUMENTS

| | | | |
|---|---|---|---|
| CN | 2427647 | Y | 4/2001 |
| CN | 101985748 | A | 3/2011 |

(Continued)

OTHER PUBLICATIONS

"Electroless Nickel—Wikipedia", May 26, 2015, XP055374263.

(Continued)

*Primary Examiner* — Juan G Flores

(74) *Attorney, Agent, or Firm* — Birch, Stewart, Kolasch & Birch, LLP.

(57) ABSTRACT

An impeller for a rotary machine includes a base material of the impeller made of Al or an Al alloy. A surface layer for the impeller is formed by an electroless plating layer with a Ni—P based alloy and an under layer disposed between the base material and the surface layer, the under layer having a smaller Vickers hardness than the surface layer.

6 Claims, 7 Drawing Sheets

(52) U.S. Cl.
CPC ..... *F04D 29/023* (2013.01); *F04D 29/284* (2013.01); *F05D 2230/31* (2013.01); *F05D 2300/121* (2013.01); *F05D 2300/173* (2013.01); *F05D 2300/5021* (2013.01); *F05D 2300/604* (2013.01)

(56) References Cited

U.S. PATENT DOCUMENTS

| | | | | |
|---|---|---|---|---|
| 8,499,558 | B2 * | 8/2013 | Muenz | F02B 37/225 60/605.1 |
| 8,529,738 | B2 * | 9/2013 | Von Gutfeld | C25D 5/022 204/242 |
| 2009/0324405 | A1 | 12/2009 | Yasui et al. | |
| 2010/0322781 | A1 * | 12/2010 | Heyes | F04D 29/284 416/244 A |
| 2011/0027576 | A1 | 2/2011 | Kool et al. | |
| 2011/0206532 | A1 * | 8/2011 | Sorbo | C23C 18/32 416/241 R |

FOREIGN PATENT DOCUMENTS

| | | | | |
|---|---|---|---|---|
| CN | 102191490 | A | | 9/2011 |
| JP | 5-156418 | A | | 6/1993 |
| JP | 6-322557 | A | | 11/1994 |
| JP | H09303289 | | * | 9/1997 |
| JP | 9-303289 | A | | 11/1997 |
| JP | 11-82377 | A | | 3/1999 |
| JP | 3231336 | B2 | | 11/2001 |
| JP | 2004-176082 | A | | 6/2004 |
| JP | 2007-245567 | A | | 9/2007 |
| JP | 2007245567 | A | * | 9/2007 |
| JP | 2008-127598 | A | | 6/2008 |
| JP | 2009-270152 | A | | 11/2009 |
| JP | 2010-202900 | A | | 9/2010 |
| JP | 2014-163345 | A | | 9/2014 |

OTHER PUBLICATIONS

Partial Supplementary European Search Report effective Feb. 23, 2018, issued to the corresponding EP Application No. 15885406.7.

Extended European Search Report effective Jun. 13, 2018 issued to the corresponding EP Application No. 15885406.7.

Office Action effective Sep. 25, 2018, issued to the corresponding Chinese Application No. 201580075409.2 with a Machine Translation.

International Preliminary Report on Patentability and Written Opinion of the International Searching Authority (Forms PCT/IB/338, PCT/IB/373, PCT/IB/326 and PCT/ISA/237) for International Application No. PCT/JP2015/057825, dated Sep. 28, 2017, with an English translation of the Written Opinion.

International Search Report (Forms PCT/ISA/210 and PCT/ISA/220) for International Application No. PCT/JP2015/057825, dated Jun. 23, 2015.

Japanese Office Action, dated Sep. 20, 2019; for Japanese Application No. 2017-507241, with an English translation.

International Preliminary Report on Patentability and Written Opinion of the International Searching Authority (Forms PCT/IB/338, PCT/IB/373, PCT/ISA/237 and PCT/IB/326) issued in International Application No. PCT/JP2015/059092 dated Oct. 5, 2017, together with an English translation.

International Search Report (Forms PCT/ISA/210 and PCT/ISA/220) issued in International Application No. PCT/JP2015/059092 dated May 26, 2015.

Notice of Revocation dated Jun. 6, 2019 issued to the corresponding Japanese Application No. 2017-507241 (appeal No. 2019-700116) with an English Translation.

Office Action and Search Report dated Nov. 13, 2018 issued to the corresponding Chinese Application No. 201580075410.5 with a machine translation.

Office Action dated Jan. 26, 2018 in the corresponding Japanese Application No. 2017-507241.

Opposition to Registration dated Feb. 13, 2019 issued to the corresponding Japanese Application No. 2017-507241 (appeal No. 2019-700116).

Taheri, "Evaluation of Electroless Nickel-Phosphorus (EN) Coatings," Thesis Submitted to the College of Graduate Studies and Research, University of Saskatchewan, Aug. 2002, pp. 1-240 (261 pages total).

US Office Action for U.S. Appl. No. 15/546,453, dated Aug. 6, 2019.

U.S. Office Action, dated Dec. 5, 2019, for U.S. Appl. No. 15/546,453.

U.S. Office Action, dated Apr. 1, 2020, for U.S. Appl. No. 15/546,453.

* cited by examiner

| MATERIAL | LINEAR EXPANSION COEFFICIENT (1/degK, ROOM TEMP.) | HARDNESS (HV) |
|---|---|---|
| ALUMINUM BASE MATERIAL (Al ALLOY) | $23\times10^{-6}$ | 100-200HV |
| SURFACE LAYER/ ELECTROLESS Ni PLATING LAYER | $13\times10^{-6}$ | 500-700HV |
| UNDER LAYER/ ELECTROLESS Cu PLATING LAYER | $19\times10^{-6}$ | 100-500HV |
| UNDER LAYER/ ELECTROLESS Sn PLATING LAYER | $22\times10^{-6}$ | ~100HV |

IMPELLER FOR ROTARY MACHINE, COMPRESSOR, SUPERCHARGER, AND METHOD FOR PRODUCING IMPELLER FOR ROTARY MACHINE

TECHNICAL FIELD

The present disclosure relates to an impeller for a rotary machine, a compressor provided with the impeller, a supercharger, and a method for producing the impeller.

BACKGROUND ART

An internal combustion engine for an automobile, a diesel engine in particular, is often provided with an exhaust gas recirculation (EGR) system. A part of exhaust gas is introduced into a compressor for a supercharger mounted to an internal combustion engine provided with an EGR system, and thus erosion is likely to occur on the compressor impeller due to droplets contained in the exhaust gas. Thus, as a countermeasure against erosion, Ni—P based plating is applied to a compressor impeller made of an Al alloy or the like.

Further, a stress due to a centrifugal force generated from high-speed rotation and a stress due to a thermal expansion difference between a Ni—P based plating layer and an Al alloy are generated in a compressor impeller of a supercharger. Thus, a plating layer is required to have not only an anti-erosion property but also an anti-crack property (fatigue strength) and an anti-separation property (interface strength).

Once a crack develops on a plating layer, the crack advances to a base material and may break the base material.

Patent Document 1 discloses applying Ni—P based alloy plating to a compressor impeller for a supercharger mounted to a ship diesel engine equipped with an EGR system, to improve an anti-erosion property and an anti-corrosion property.

CITATION LIST

Patent Literature

Patent Document 1: JP2014-163345A

SUMMARY

Problems to be Solved

While the thickness of a plating layer could be increased to improve the anti-erosion property of the plating layer, a plating layer with an excessively-increased thickness is more likely to separate from the surface of a base material and has a greater risk of generation of fatigue cracks on the surface of the plating layer. On the other hand, a coating layer with a reduced thickness is less likely to generate fatigue cracks, but the anti-erosion property may decrease.

As described above, the anti-erosion property and the anti-crack property have a trade-off relationship, and it is difficult to satisfy both of these requirements at the same time.

In view of the above problem of typical art, at least one embodiment of the present invention is to form a plating layer to improve an anti-erosion property and an anti-crack property of an impeller for a rotary machine to prevent formation of cracks.

Solution to the Problems (1) An impeller for a rotary machine according to at least one embodiment of the present invention includes: a base material of the impeller comprising Al or an Al alloy; a surface layer for the impeller formed by an electroless plating layer comprising a Ni—P based alloy; and an under layer disposed between the base material and the surface layer, the under layer having a smaller Vickers hardness than the surface layer.

With the above configuration (1), the surface layer formed of a Ni—P based alloy has a high Vickers hardness, and thus has an excellent anti-erosion property. The surface layer is an electroless plating layer and thus can be formed to have a uniform layer thickness, and thus it is possible to exert the anti-erosion property of the electroless plating layer uniformly over a broad range.

The under layer has a smaller Vickers hardness than the surface layer, thus having a higher ductility than the surface layer, and thereby has an effect to suppress development of cracks formed on the surface layer. Thus, even if a crack is formed on the surface layer, the under layer can suppress further development of the crack and to prevent the crack from reaching the base material.

(2) In some embodiments, in the above configuration (1), the surface layer has an amorphous structure.

With the above configuration (2), the surface layer has an amorphous structure and thus has a high strength and an improved anti-erosion property. Furthermore, by employing a surface layer having an amorphous structure, it is possible to improve the fatigue strength of the surface layer itself.

(3) In some embodiments, in the above configuration (1) or (2), the surface layer has a P content rate of not less than 4 wt % and not more than 10 wt %.

According to the above configuration (3), the surface layer contains P of not less than 4 wt % and not more than 10 wt %, and has a high Vickers hardness and it is possible to further improve the anti-erosion property. Further, with the P content rate being in the above range, the fatigue strength of the surface layer improves.

(4) In some embodiments, in any one of the above configurations (1) to (3), the under layer comprises a plating layer containing Ni.

With the above configuration (4), the under layer contains Ni like the surface layer, and thus the two layers fit well, which facilitates application of the surface layer onto the under layer and improves the adherence between the two layers.

The under layer may be an electroless plating layer or an electrolytic plating layer. While an electrolytic plating layer is inferior to an electroless plating layer in terms of layer uniformity such as the layer thickness, an electrolytic plating layer has an extremely high ductility, and thus has an effect to suppress progress of cracks formed on the surface layer. Thus, even if a crack is formed on the surface layer, the under layer can suppress further development of the crack and to prevent the crack from reaching the base material.

(5) In some embodiments, in the above configuration (4), the plating layer serving as the under layer comprises a Ni—P based alloy having an amorphous structure, the Ni—P based alloy having a P content rate of not less than 10 wt % and not more than 13 wt % in the under layer.

With the above configuration (5), the under layer has an amorphous structure and thus has a high strength, while containing P of not less than 10 wt % and not more than 13 wt % and thus having a high ductility. Thus, the under layer has an effect to suppress development of cracks formed on the surface layer. Even if a crack is formed on the surface layer, the under layer can suppress further development of the crack and to prevent the crack from reaching the base material.

(6) In some embodiments, in the above configuration (4) or (5), the Ni plating layer serving as the under layer is an electrolytic plating layer having a Vickers hardness of not more than 350 HV, preferably, not less than 200 HV and not more than 300 HV.

With the above configuration (6), the under layer is an electrolytic plating layer that has a Vickers hardness of not more than 350 HV, and thus has an extremely high ductility. Thus, the under layer has an effect to suppress development of cracks formed on the surface layer. Even if a crack is formed on the surface layer, the under layer can suppress further development of the crack and to prevent the crack from reaching the base material.

(7) In some embodiments, in the above configuration (1), the under layer is a plating layer containing Cu or Sn.

With the above configuration (7), Cu and Sn have a high ductility, and thus, when used as the under layer, have an effect to suppress development of cracks formed on the surface layer. Thus, even if a crack is formed on the surface layer, the under layer can suppress further development of the crack and to prevent the crack from reaching the base material.

(8) In some embodiments, in any one of the above configurations (1) to (7), the under layer has a linear expansion coefficient between those of the base material and the surface layer.

With the above configuration (8), the under layer has a linear expansion coefficient between the base material and the surface layer, and thus is capable of mitigating the thermal expansion difference between the surface layer and the base material of the impeller when interposed therebetween. Thus, it is possible to mitigate the stress applied to the surface layer due to the thermal expansion difference, and to suppress generation of cracks on the surface layer.

(9) In some embodiments, in any one of the above configurations (1) to (8), the surface layer has a layer thickness of not less than 15 μm and not more than 60 μm.

If the layer thickness of the surface layer is less than 15 μm, it may be difficult to exert the anti-erosion property sufficiently. On the other hand, even if the layer thickness is increased to exceed 60 μm, the effect to improve the anti-erosion property is limited, which rather increases the plating time and costs.

With the above configuration (9), it is possible to achieve the anti-erosion property when the surface layer has a layer thickness of not less than 15 μm, and it is possible to reduce the plating costs when the surface layer 54 has a layer thickness of not more than 60 μm or less.

(10) In some embodiments, in any one of the above configurations (1) to (9), the surface layer has a Vickers hardness of 500 to 700 HV.

With the above configuration (10), the surface layer has a high Vickers hardness of 500 to 700 HV, and thus can have a high anti-erosion property.

(11) In some embodiments, in any one of the above configurations (1) to (10), the under layer has a layer thickness of not less than 15 μm and not more than 60 μm.

If the layer thickness of the under layer is less than 15 μm, it may be difficult to exert the function to prevent cracks formed on the surface layer sufficiently. On the other hand, even if the layer thickness is increased to exceed 60 μm, the effect to prevent cracks is limited, which rather increase the plating time and costs.

With the above configuration (9), it is possible to exert the effect to stop cracks with the under layer having a layer thickness of not less than 15 μm, and it is possible to reduce the plating costs with the surface layer 54 having a layer thickness of 60 μm or less.

(12) In some embodiments, in any one of the above configurations (1) to (11), the impeller is a compressor impeller of a supercharger.

With the above configuration (12), a compressor impeller having the above configuration is used as the compressor impeller for a supercharger that rotates at a high speed, and thereby it is possible to improve the anti-erosion property of the supercharger and to suppress development of cracks, thus increasing the lifetime of the supercharger.

(13) A compressor according to at least one embodiment of the present invention comprises a compressor impeller which has any one of the above configurations (1) to (11).

With the above configuration (13), providing a compressor impeller with a high anti-erosion property and a crack development suppressing function makes it possible to extend the lifetime of the compressor.

(14) A supercharger according to at least one embodiment of the present invention comprises: the compressor having the above configuration (13); and a turbine for driving the compressor.

With the above configuration (14), providing a compressor including a compressor impeller with a high anti-erosion property and a crack development suppressing function makes it possible to achieve a long-life supercharger that can bear high-speed rotation for a long period of time.

(15) In some embodiments, in the above configuration (14), the compressor is disposed in an intake passage of an internal combustion engine. The turbine is configured to be driven by exhaust gas from the internal combustion engine. The supercharger is configured such that a part of the exhaust gas is circulated to the intake passage at an upstream side of the compressor.

In the above configuration (15), intake air containing exhaust gas that contains droplets and has a high erosion property is introduced into a compressor of the supercharger.

With the above configuration (15), a compressor with the above configuration (13) having an improved high anti-erosion property and anti-crack property is provided, and thereby it possible to achieve a long-life supercharger that can bear high-speed rotation for a long period of time.

(16) A method of producing an impeller for a rotary machine according to at least one embodiment of the present invention comprises: a step of forming an under layer on a base material of the impeller comprising Al or an Al alloy so as to cover the base material; and a step of forming an electroless plating layer on the under layer as a surface layer of the impeller. The under layer has a smaller Vickers hardness than the surface layer. The surface layer is an electroless plating layer comprising a Ni—P based alloy having an amorphous structure, the Ni—P based alloy having a P content rate of not less than 4 wt % and not more than 10 wt % in the surface layer.

According to the above production method (16), a plating layer including the surface layer having a high Vickers hardness and thus a high anti-erosion property and the under layer having a high ductility and an effect to prevent progress of cracks formed on the surface layer is formed on the base material of the impeller, and thus it is possible to improve the anti-erosion property and the anti-crack property of the impeller, thus increasing the lifetime of the impeller.

Advantageous Effects

According to at least one embodiment of the present invention, it is possible to form a plating layer on an impeller for a rotary machine comprising Al or an Al alloy, whereby it is possible to improve both of an anti-erosion property and an anti-crack property, and thereby improve the lifetime of the impeller.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 12:
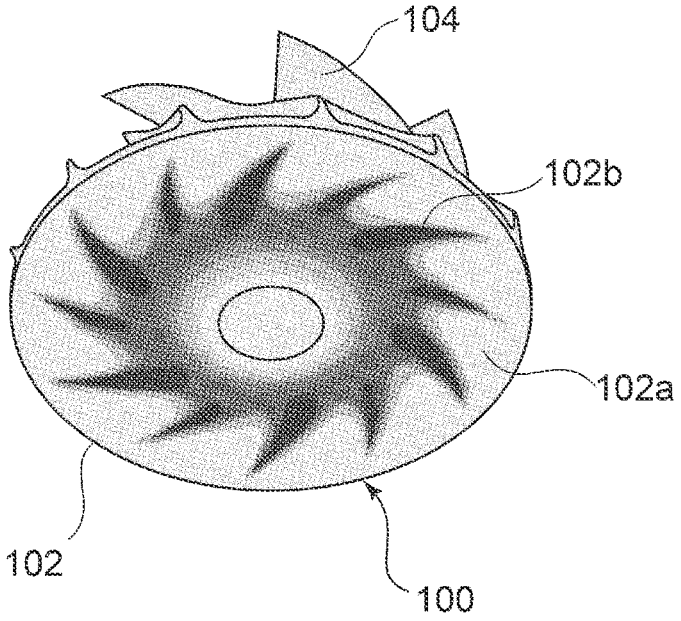
FIG. 12 is a perspective view of a distribution of strain generated in the compressor impeller.

FIG. 12 is a diagram of a compressor impeller of a supercharger provided for an automobile internal combustion engine, coated with a typical Ni—P based plating layer, shown with an analysis result of a distribution of strain generated in the compressor impeller 100 projected on a back surface 102*a* of a hub 102. FIG. 12 shows that the greatest strain, that is, stress, is generated in a region 102*b* of the hub 102, where the root portions of blades 104 are projected. This stress is mainly generated by a centrifugal force generated when the supercharger rotates at a high speed, and is further combined with a stress due to a thermal expansion difference between the Ni—P based plating layer and a base material made of an Al alloy.

Figure 1:
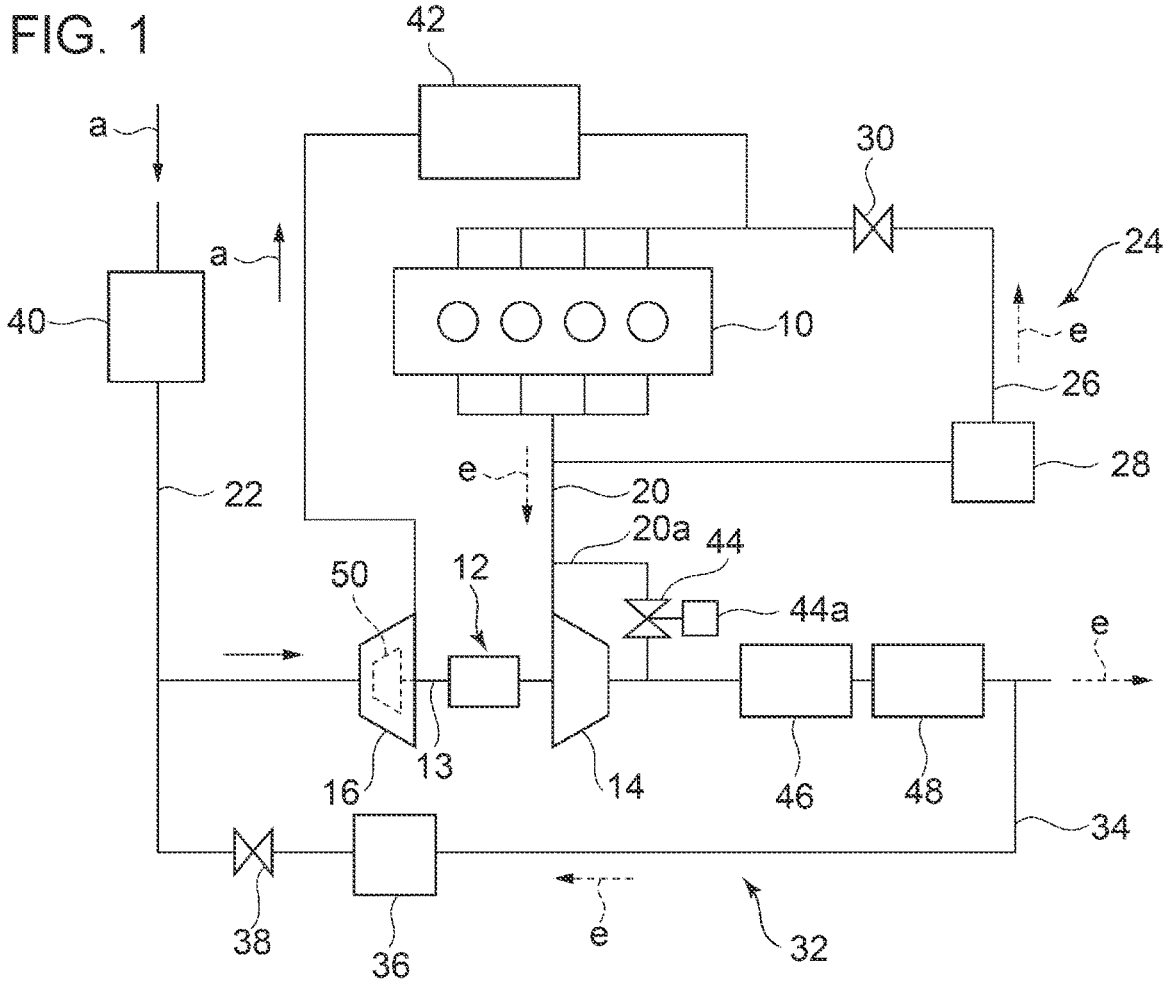
FIG. 1 is a system diagram of a diesel engine provided with a supercharger according to an embodiment.

As depicted in FIG. 1, a supercharger 12 according to at least one embodiment of the present invention is provided for an in-vehicle internal combustion engine, for instance, a diesel engine 10 equipped with an EGR system.

The supercharger 12 includes an exhaust turbine 14 which is disposed in an exhaust passage 20 of the diesel engine 10 and which is rotated by exhaust gas "e", and a compressor 16 which operates in conjunction with the exhaust turbine 14 via a rotational shaft 13. The compressor 16 is disposed in an intake passage 22, and supplies the diesel engine 10 with intake air "a". A part of exhaust gas is circulated to the intake passage 22 at an upstream side of the compressor 16.

In an exemplary embodiment, as depicted in FIG. 1, a high-pressure EGR system 24 has a high-pressure EGR passage 26 branched from the exhaust passage 20 at the upstream side of the exhaust turbine 14 and connected to the intake passage 22 at the downstream side of the compressor 16.

In the high-pressure EGR system 24, a part of the exhaust gas "e" discharged from the diesel engine 10 is returned to the intake passage 22 at the inlet side of the diesel engine 10 via the high-pressure EGR passage 26.

In an exemplary configuration, an EGR cooler 28 and an EGR valve 30 are disposed in the high-pressure EGR passage 26.

As an exemplary embodiment, a low-pressure EGR system 32 has a low-pressure EGR passage 34 branched from the exhaust passage 20 at the downstream side of the exhaust turbine 14 and connected to the intake passage 22 at the upstream side of the compressor 16.

In the low-pressure EGR system 32, a part of the exhaust gas "e" discharged from the diesel engine 10 is returned to the intake passage 22 at the inlet side of the compressor 16 via the low-pressure EGR passage 34.

In an exemplary configuration, an EGR cooler 36 and an EGR valve 38 are disposed in the low-pressure EGR passage 34.

In an exemplary embodiment, an air cleaner 40 is disposed in the intake passage 22 at the upstream side of the compressor 16, and an inter cooler 42 is disposed in the intake passage 22 at the downstream side of the compressor 16.

Further, an exhaust bypass passage 20*a* is connected to the exhaust passage 20 so as to bypass the exhaust turbine 14. A waste valve 44 is disposed in the exhaust bypass passage 20*a*, and an actuator 44*a* for adjusting the opening degree of the waste valve 44 is provided.

Further, a DPF filter 48 for capturing particulate matter in the exhaust gas, and an oxidation catalyst 46 for oxidizing NOx in the exhaust gas to $NO_2$ and combusting the particulate matter captured by the DPF filter 48 by oxidation of $NO_2$ are disposed in the exhaust passage 20 at the downstream side of the exhaust turbine 14.

A compressor according to at least one embodiment of the present invention is the compressor 16 provided for the supercharger 12 depicted in FIG. 1. The compressor 16 includes a compressor impeller 50 disposed on an end of the rotational shaft 13 inside a compressor housing (not depicted).

Figure 2:
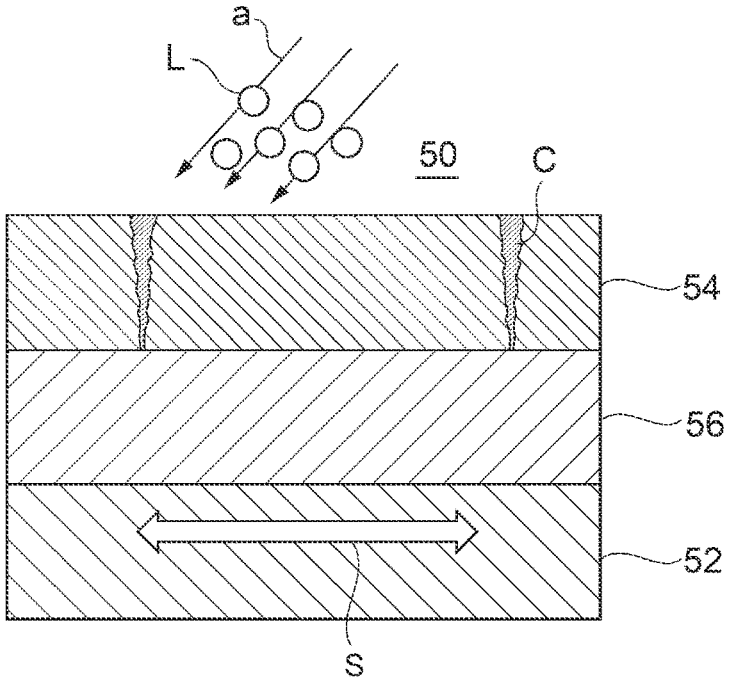
FIG. 2 is a schematic cross-sectional view of a compressor impeller according to an embodiment.

As schematically shown in FIG. 2, the compressor impeller 50 includes a base material 52 comprising Al or an Al alloy, a surface layer 54 formed on the surface of the base material 52 of a Ni—P based alloy electroless plating layer, and an under layer 56 having a smaller Vickers hardness than the surface layer 54.

The surface layer 54 formed of a Ni—P based alloy electroless plating layer has a high Vickers hardness, and thus has an excellent anti-erosion property. Moreover, the surface layer 54 is an electroless plating layer and thus can be formed to have a uniform layer thickness, and thus it is possible to exert the anti-erosion property uniformly over a broad range.

As depicted in FIG. 2, the intake air "a" may contain a foreign substance such as a droplet L. For instance, if the low-pressure EGR system 32 depicted in FIG. 1 is employed, the exhaust gas "e" containing a water droplet L is circulated via the low-pressure EGR passage 34 and is supplied to the compressor with the intake air "a". As described above, even if the intake air "a" contains a foreign substance (e.g. droplet L), the surface layer 54 has a good anti-erosion property, thus being resistant to erosion by the exhaust gas "e".

A centrifugal force is applied to the base material 52 due to rotation of the compressor impeller 50, and generates a strain S in the base material 52. In this regard, the surface layer 54 has a high Vickers hardness from the perspective of the anti-erosion property. Thus, the surface layer 54 has a low ductility. If a strain S is generated in the base material 52, the surface layer 54 cannot follow the strain S, and a crack C may occur.

However, according to the above embodiment, the under layer 56 has a high ductility (a small Vickers hardness) compared to the surface layer 54, and thus even if the crack C is formed on the surface layer 54, the under layer 56 can suppress further development of the crack and to prevent the crack from reaching the base material 52.

In an illustrative embodiment, the surface layer 54 has an amorphous structure. The surface layer 54 having an amorphous structure has a high strength and it is possible to improve the anti-erosion property.

In an illustrative embodiment, the surface layer 54 contains P of not less than 4 wt % and not more than 10 wt %. When containing P of not less than 4 wt % and not more than 10 wt %, the surface layer 54 has a high Vickers hardness and it is possible to further improve the anti-erosion property.

Figure 3:
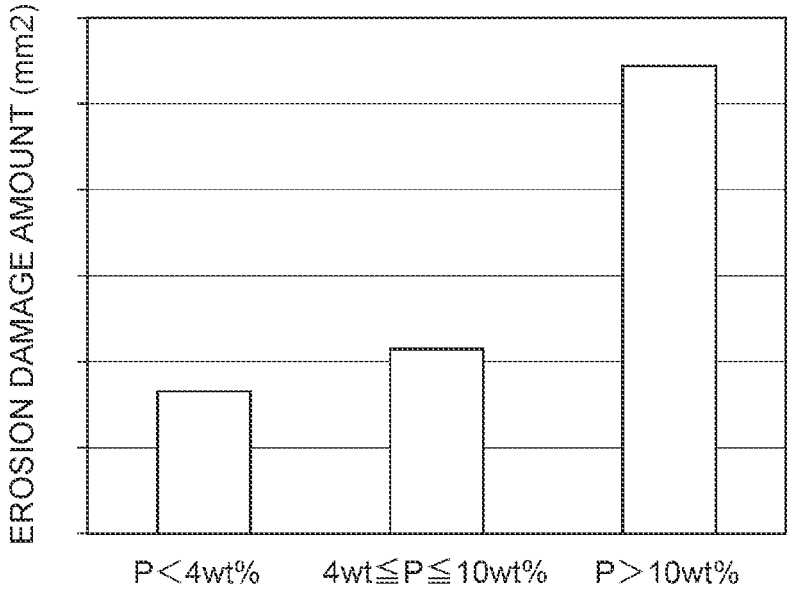
FIG. 3 is a diagram showing a relationship between the P content rate and the anti-erosion property of an electroless plating layer.
Figure 4:
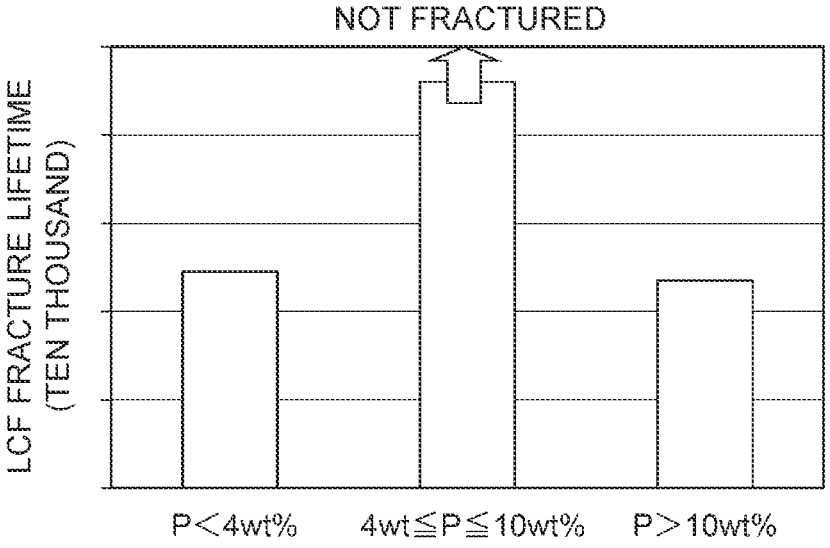
FIG. 4 is a diagram showing a relationship between the P content rate and the LCF fracture lifetime of an electroless plating layer.

FIG. 3 is a test result showing a relationship between the P content rate and the anti-erosion property of the electroless plating layer. FIG. 4 is a test result showing the P content rate and the low-cycle fatigue (LCF) test fracture lifetime of the electroless plating layer. The low-cycle fatigue (LCF) is a fatigue fracture that develops on a member when such a great cyclic load that causes plastic deformation is applied to the member.

Figure 5:
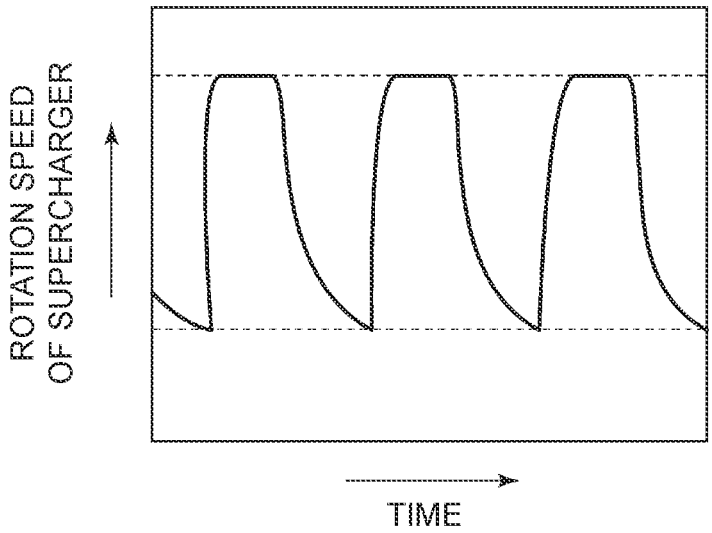
FIG. 5 is a diagram of an example of a cyclic load in an LCF test.

FIG. 5 is a diagram of an example of a cyclic load applied to a compressor impeller in an LCF test, where x-axis is time and y-axis is rotation speed of a supercharger equipped with the compressor impeller. A change in the rotation speed of the supercharger changes the stress applied to the surface layer 54.

As depicted in FIGS. 3 and 4, the anti-erosion property rapidly decreases when the P content rate exceeds 10 wt %, while the LCF fracture lifetime decreases when the P content rate is less than 4 wt % or more than 10 wt %. From the above result, the surface layer 54 contains P of not less than 4 wt % and not more than 10 wt % to balance the anti-erosion property and the LCF fracture lifetime.

Figure 6:
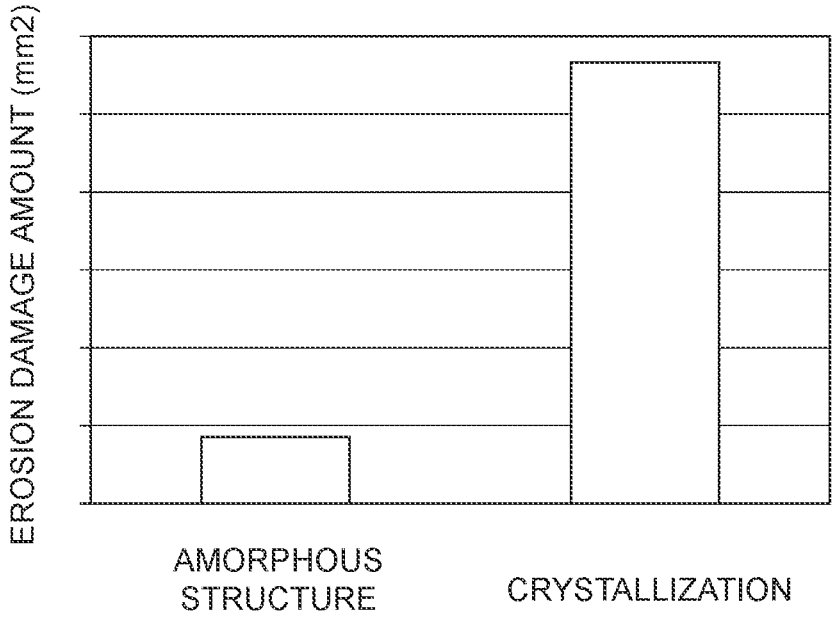
FIG. 6 is a diagram showing a relationship between the crystal structure and the anti-erosion property of an electroless plating layer.
Figures 7, 8:
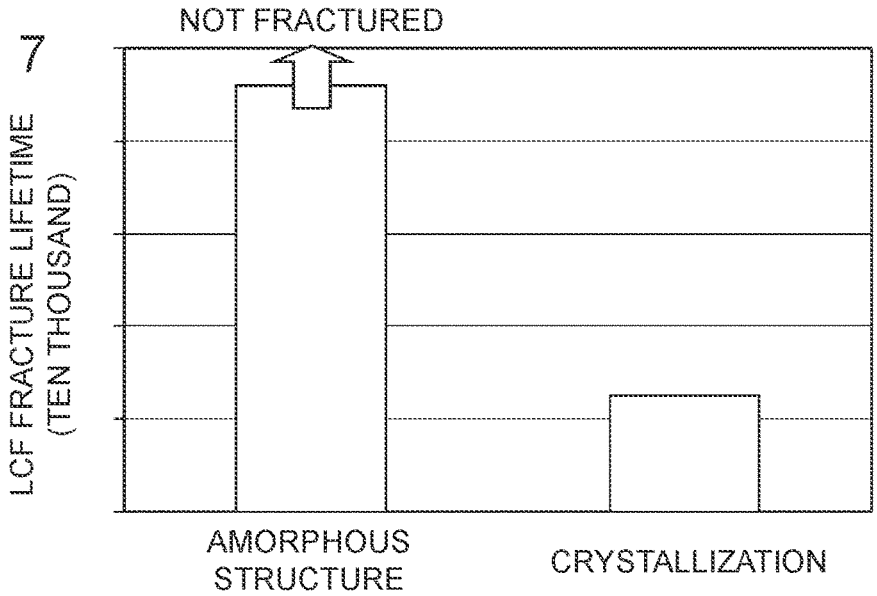
FIG. 7 is a diagram showing a relationship between the crystal structure and the LCF fracture lifetime of an electroless plating layer.
FIG. 8 is a chart showing the linear expansion coefficient of the base material and each plating layer.

FIG. 6 is a test result showing a relationship between different crystal structures and the anti-erosion property of the surface layer 54. FIG. 7 is a test result showing a relationship between different crystal structures and the LCF fracture lifetime of the surface layer 54. The "crystallization" in the drawings means that the surface layer 54 having an amorphous structure is crystallized by heat treatment.

As depicted in FIGS. 6 and 7, when the surface layer 54 is crystallized, the anti-erosion property and the LCF fracture lifetime deteriorate rapidly. From the above result, the surface layer 54 has an amorphous structure and contains P of 4 to 10 wt % to improve the anti-erosion property and the LCF fracture lifetime.

In an illustrative embodiment, the under layer 56 is a plating layer containing Ni. Accordingly, the under layer 56 fits with the surface layer 54 better, whereby the surface layer 54 can be more easily applied to the under layer 56, and the two layers can be in closer contact.

The under layer 56 may be an electroless plating layer or an electrolytic plating layer. While an electrolytic plating layer is inferior to an electroless plating layer in terms of layer uniformity such as the layer thickness, an electrolytic plating layer has an extremely high ductility, and thus has an effect to suppress progress of cracks formed on the surface layer 54. Thus, even if a crack is formed on the surface layer 54, the under layer 56 can suppress further development of the crack and to prevent the crack from reaching the base material 52.

In an illustrative embodiment, the under layer 56 has an amorphous structure and comprises Ni—P based alloy in which the P content rate of the under layer 56 is not less than 10 wt % and not more than 13 wt %. For instance, the under layer 56 may be an electroless plating layer of Ni—P based alloy with the P content rate being in the above range and having an amorphous structure.

The under layer 56 has an amorphous structure and thus has a high strength. Thus, as described above, the anti-erosion property and the LCF fracture lifetime rapidly improve compared to a crystallized structure.

Furthermore, if the P content rate of the under layer 56 is not less than 10 wt % and not more than 13 wt %, the under layer 56 has a high ductility, and thus has an effect to suppress development of cracks formed on the surface layer 54. Thus, even if a crack is formed on the surface layer 54, the under layer 56 can suppress further development of the crack and to prevent the crack from reaching the base material 52.

In an illustrative embodiment, if the under layer 56 contains Ni, the under layer 56 is an electrolytic plating layer having a Vickers hardness of not more than 350 HV, preferably, not less than 200 HV and not more than 300 HV. Accordingly, the under layer 56 has a high ductility, and thus has an effect to suppress development of cracks formed on the surface layer 54. Thus, even if a crack is formed on the surface layer 54, the under layer 56 can suppress further development of the crack and to prevent the crack from reaching the base material 52.

In an illustrative embodiment, the under layer 56 is a plating layer containing Cu or Sn. Cu and Sn have a high ductility, and thus, when used as the under layer 56, have an effect to suppress development of cracks formed on the surface layer 54. Thus, even if a crack is formed on the surface layer 54, the under layer 56 can suppress further development of the crack and to prevent the crack from reaching the base material 52.

In an illustrative embodiment, the under layer 56 has a linear expansion coefficient between those of the base material 52 and the surface layer 54. With the under layer 56 being disposed between the base material 52 and the surface layer 54, it is possible to reduce the thermal expansion difference between the base material 52 and the surface layer 54. Thus, it is possible to mitigate the stress applied to the surface layer 54 due to the thermal expansion difference, and to suppress generation of cracks on the surface layer.

FIG. 8 is an example of linear expansion coefficients of the base material 52, the surface layer 54, and the under layer 56.

In an illustrative embodiment, the surface layer 54 has a layer thickness of not less than 15 μm and not more than 60 μm. If the layer thickness is less than 15 μm, the surface layer cannot exert the anti-erosion property. On the other hand, even if the layer thickness of the surface layer 54 is increased to exceed 60 μm, the effect to improve the anti-erosion property is limited, which rather increases the plating time and costs.

Accordingly, it is possible to achieve the anti-erosion property with the surface layer 54 having a layer thickness of not less than 15 μm, and it is possible to reduce the plating costs with the surface layer 54 having a layer thickness of not more than 60 μm.

Figure 9:
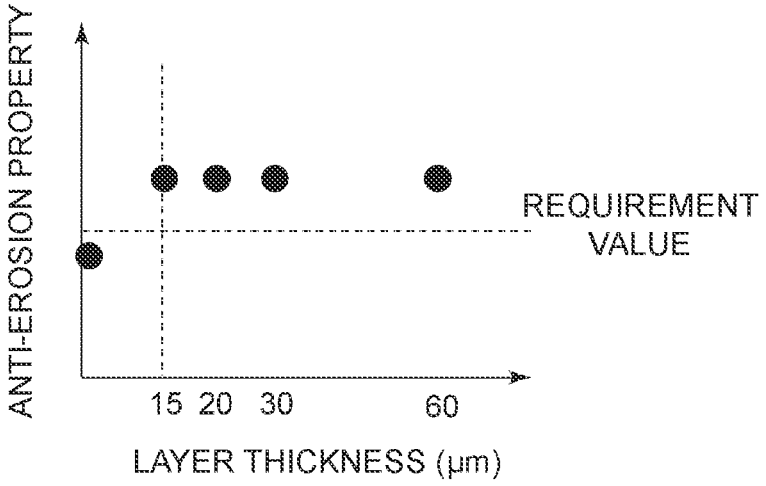
FIG. 9 is a diagram showing a relationship between the layer thickness and the anti-erosion property of an electroless plating layer.
Figure 10:
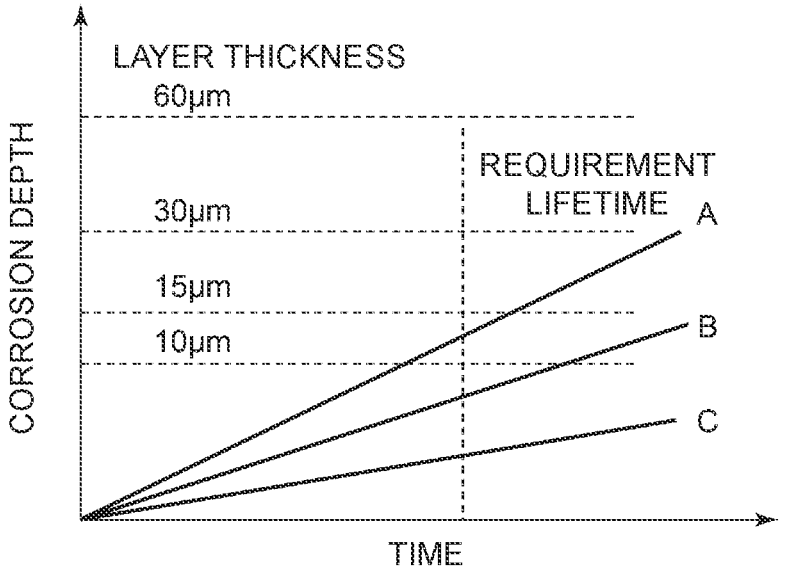
FIG. 10 is a diagram showing a result of a corrosion test on an electroless plating layer.

FIG. 9 is a test result showing a relationship between the layer thickness and the anti-erosion property of the surface layer 54. FIG. 10 is a test result showing a relationship between the anti-erosion property and the layer thickness of the surface layer 54.

As depicted in FIG. 9, the surface layer 54 cannot exert the anti-erosion property when having a layer thickness of about 1 to 2 μm, but can exert a high anti-erosion property that satisfies a requirement value when having a layer thickness in the range of 15 to 60 μm.

The lines A, B, and C in FIG. 10 show the progress of corrosion on the surface layer 54 for different corrosion environments. FIG. 10 shows that the requirement lifetime can be satisfied when the surface layer 54 has a layer thickness of not less than 15 μm, even in the most severe corrosion environment.

In an illustrative embodiment, the surface layer 54 has a Vickers hardness of 500 to 700 HV. Accordingly, the surface layer 54 has a high Vickers hardness, and thus can have a high anti-erosion property.

In an illustrative embodiment, the layer thickness of the under layer 56 is not less than 15 μm and not more than 60 μm. If the layer thickness of the under layer 56 is less than 15 μm, the under layer 56 cannot exert a sufficient performance to prevent cracks formed on the surface layer 54. On the other hand, even if the layer thickness is increased to exceed 60 μm, the effect to improve the anti-erosion property is limited, which rather increases the plating time and costs.

Accordingly, it is possible to exert the effect to stop cracks with the under layer 56 having a layer thickness of not less than 15 μm, and it is possible to reduce the plating costs with the surface layer 54 having a layer thickness of not more than 60 μm.

The compressor impeller 50 having the above configuration is used as the compressor impeller of a compressor 16 constituting the supercharger 12 that rotates at a high speed, and thereby it is possible to improve the anti-erosion property of the supercharger 12 and the compressor impeller 16 and to restrict development of cracks, thus increasing the lifetime of the above apparatuses.

Furthermore, even if the supercharger 12 is provided for the diesel engine 10 having the low-pressure EGR system 32 and the intake air "a" containing droplets and having a high erosive property is introduced into the compressor 16, the supercharger 12 can endure high-speed rotation for a long time and the lifetime can be improved.

Figure 11:
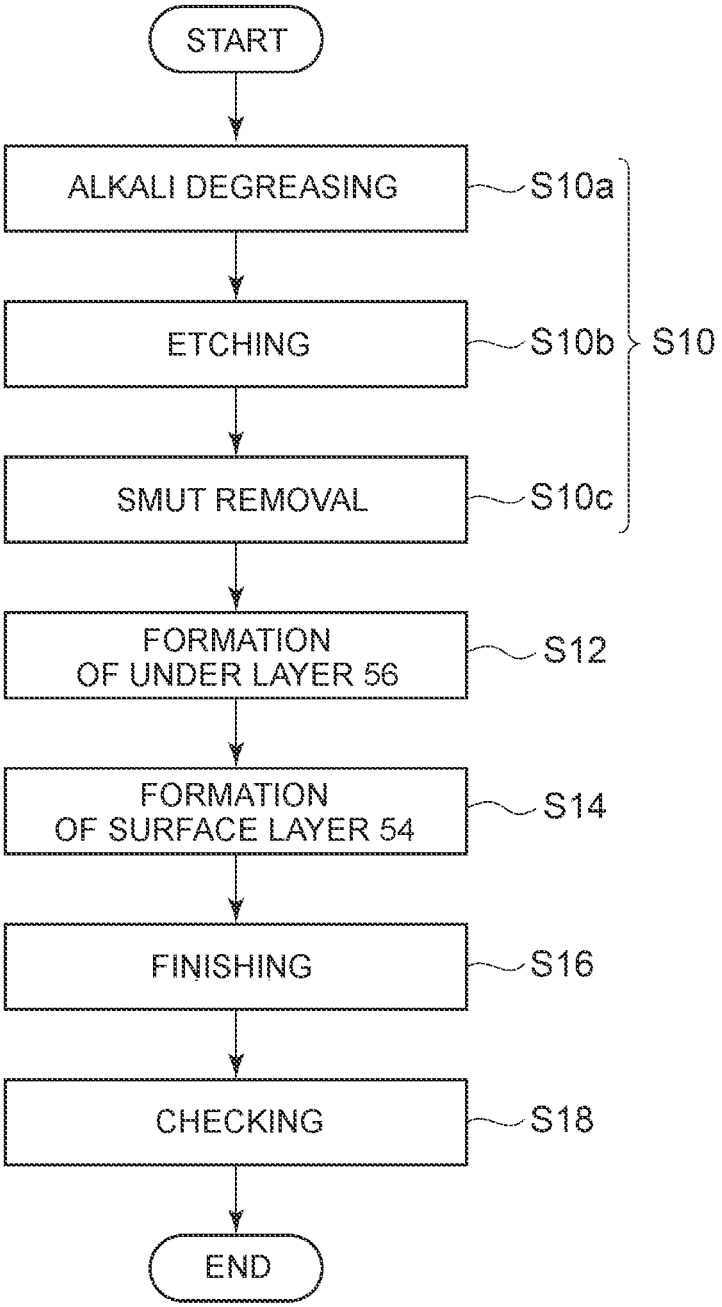
FIG. 11 is a flowchart of a method of producing a compressor impeller according to an embodiment.

A method of producing a compressor impeller 50 according to at least one embodiment of the present invention comprises a step (S12) of forming the under layer 56 that substantially covers the entire surface of the compressor impeller 50 on the base material 52 constituting the compressor impeller 50, as depicted in FIG. 11 (S12). Subsequently, an electroless plating layer is formed as the surface layer 54 on the under layer 56 (S14).

The under layer 56 has a smaller Vickers hardness than the surface layer 54, and the surface layer 54 is an electroless plating layer comprising a Ni—P based alloy which has an amorphous structure and contains P of 4 to 10 wt %.

In an illustrative embodiment, as depicted in FIG. 11, a pretreatment S10 is performed on the surface of the base material 52 prior to step S12.

The pretreatment S10 includes an alkali degreasing step S10*a* of removing grease or the like adhering to the surface of the base material 52 with an alkali solution or the like, an etching treatment step S10*b* of removing a passive state layer (alumina layer) formed on the surface of the degreased base material 52 by using an acid solution or an alkali solution, and a smut removing step S10*c* of removing smut which is C and Si less soluble to acid or the like remaining in the form of black powder after the etching treatment.

In an illustrative embodiment, after step S14, performed are a step S16 of finishing the surface of the surface layer 54 and a check step S18 of checking the finished surface layer 54.

According to the above production method, a plating layer including the surface layer 54 having a high Vickers hardness and thus a high anti-erosion property and the under layer 56 having a high ductility and an effect to prevent progress of cracks formed on the surface layer is formed on the base material 52, and thus it is possible to improve the anti-erosion property and the anti-crack property of the compressor impeller 50, thus improving the lifetime of the compressor impeller 50.

While a single layer of the under layer 56 is formed between the base material 52 and the surface layer 54, two or more under layers may be formed.

INDUSTRIAL APPLICABILITY

According to at least one embodiment of the present invention, it is possible to form an electroless plating layer on an impeller for a rotary machine comprising Al or an Al alloy, whereby it is possible to improve both of an anti-erosion property and an anti-crack property, and thereby improve the lifetime of the impeller and apparatuses including the impeller.

DESCRIPTION OF REFERENCE NUMERALS

10 Diesel engine
12 Supercharger
13 Rotational shaft
14 Exhaust turbine
16 Compressor
20 Exhaust passage
22 Intake passage
24 High-pressure EGR system
26 High-pressure EGR passage
28, 36 EGR cooler
30, 38 EGR valve
32 Low-pressure EGR system
34 Low-pressure EGR passage
40 Air cleaner
42 Inter cooler
44 Waste valve
44*a* Actuator
46 Oxidation catalyst
48 DPF filter
50, 100 Compressor impeller
52 Base material
54 Surface layer
56 Under layer
102 Hub
102*a* Back surface
104 Blade
C Crack
S Strain
a Intake air
e Exhaust gas

The invention claimed is:

1. An impeller for a rotary machine, comprising:

a base material of the impeller comprising Al or an Al alloy;

a surface layer for the impeller formed by an electroless plating layer comprising a Ni—P based alloy; and an under layer disposed between the base material and the surface layer, the under layer having a smaller Vickers hardness than the surface layer, wherein the under layer comprises a plating layer containing Ni, wherein the plating layer serving as the under layer comprises a Ni—P based alloy having an amorphous structure, the Ni—P based alloy having a P content rate of not less than 10 wt % and not more than 13 wt % in the under layer.

2. The impeller for a rotary machine according to claim 1, wherein the Ni plating layer serving as the under layer is an electrolytic plating layer having a Vickers hardness of not more than 350 HV.

3. A compressor comprising a compressor impeller which comprises an impeller according to claim 1.

4. A supercharger, comprising:

a compressor according to claim 3; and a turbine for driving the compressor.

5. The supercharger according to claim 4, wherein the compressor is disposed in an intake passage of an internal combustion engine, wherein the turbine is configured to be driven by exhaust gas from the internal combustion engine, and wherein the supercharger is configured such that a part of the exhaust gas is circulated to the intake passage at an upstream side of the compressor.

6. A method of producing an impeller for a rotary machine, the method comprising:

a step of forming an under layer comprising a plating layer containing Ni on a base material of the impeller comprising Al or an Al alloy so as to cover the base material; and a step of forming an electroless plating layer comprising a Ni—P based alloy on the under layer as an outermost layer of the impeller, wherein the under layer has a smaller Vickers hardness than the outermost layer, and wherein the plating layer serving as the under layer comprises a Ni—P based alloy having an amorphous structure, the Ni—P based alloy having a P content rate of not less than 10 wt % and not more than 13 wt % in the under layer.

* * * * *